US005988379A

United States Patent [19]

Yearous

[11] Patent Number: 5,988,379

[45] Date of Patent: Nov. 23, 1999

[54] GOLF BAG WITH DIVIDED BALL POUCH, SLIDING SHELVES, AND CART STRAP SECURING SYSTEM

[75] Inventor: Jeffrey Blaine Yearous, Carlsbad, Calif.

[73] Assignee: Taylor Made Golf Company, Inc., Carlsbad, Calif.

[21] Appl. No.: 09/136,091

[22] Filed: Aug. 18, 1998

[51] Int. Cl.[6] ..... A63B 55/00; A63B 55/02

[52] U.S. Cl. ..... 206/315.3; 206/315.5

[58] Field of Search ..... 206/315.3, 315.5, 206/315.7; 224/274, 572

[56] References Cited

U.S. PATENT DOCUMENTS

| | | | |
|---|---|---|---|
| 1,676,592 | 7/1928 | White | 206/315.5 |
| 1,709,582 | 4/1929 | Kahle | 206/315.5 |
| 1,737,967 | 12/1929 | Hall | 206/315.5 |
| 1,845,088 | 2/1932 | Hunerhoff | 206/315.5 |
| 2,438,078 | 3/1948 | Sutphen | 306/315.3 X |
| 4,350,194 | 9/1982 | Brown | 206/315.5 |
| 4,522,299 | 6/1985 | Clark et al. | 206/315.3 |
| 4,793,508 | 12/1988 | Thompson | 190/110 X |
| 4,796,752 | 1/1989 | Reimers | 206/315.3 |
| 4,890,705 | 1/1990 | Pineda | 190/110 X |
| 5,123,531 | 6/1992 | Beretta | 206/315.3 |
| 5,168,992 | 12/1992 | Bowdy | 206/315.5 X |
| 5,215,194 | 6/1993 | Blanford et al. | 206/315.5 X |
| 5,222,598 | 6/1993 | Yamazoe | 206/315.5 |
| 5,240,106 | 8/1993 | Plath | 190/102 X |
| 5,295,565 | 3/1994 | Latshaw | 190/18 A |
| 5,402,883 | 4/1995 | Shin | 206/315.5 X |
| 5,566,825 | 10/1996 | Price | 206/315.5 |
| 5,632,496 | 5/1997 | Nelson | 280/30 |
| 5,699,906 | 12/1997 | Lombardo et al. | 206/315.3 |
| 5,860,520 | 1/1999 | Tang | 206/315.6 |

FOREIGN PATENT DOCUMENTS

| | | | |
|---|---|---|---|
| 2134797 | 8/1984 | United Kingdom | 206/315.3 |

*Primary Examiner*—Sue A. Weaver
*Attorney, Agent, or Firm*—John L. Rogitz

[57] ABSTRACT

A golf bag includes a club carrier and a ball pouch, the bottom edge of which is hingedly attached to the carrier for movement between an open configuration, wherein a storage pouch is exposed, and a closed configuration. A divider in the ball pouch bisects the pouch. Also, a panel on the carrier establishes a sundry chamber, and shelves are slidably disposed in the sundry chamber. Moreover, the top of the club carrier defines an open end that is reinforced by a stiff collar, and a horizontal tube is positioned next to the collar. A strap of a golf cart can be threaded through the tube to secure the golf bag to the golf cart without crushing items in the golf bag.

37 Claims, 3 Drawing Sheets

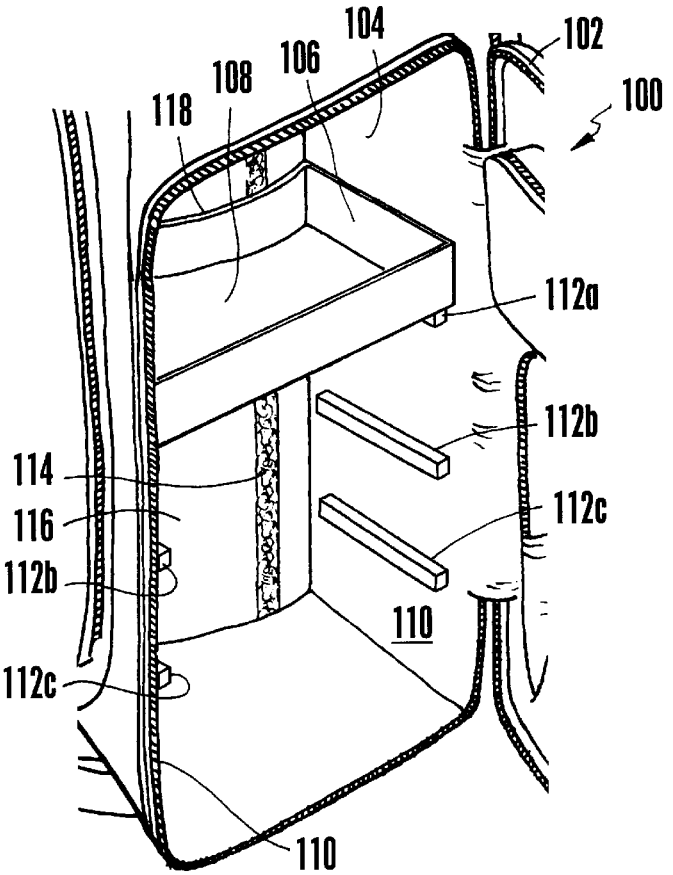
Fig.3
Fig. 5
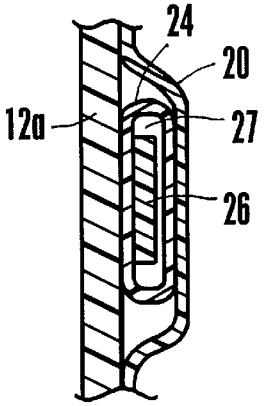
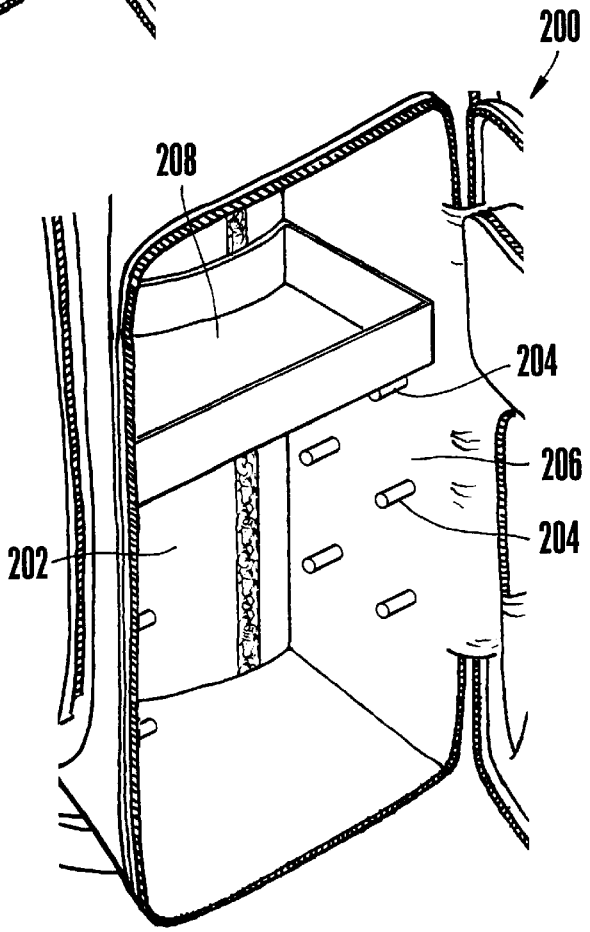
Fig.4

GOLF BAG WITH DIVIDED BALL POUCH, SLIDING SHELVES, AND CART STRAP SECURING SYSTEM

FIELD OF THE INVENTION

The present invention relates generally to golf, and more particularly to golf bags.

BACKGROUND

Golf bags have been provided for carrying golf clubs, golf balls, and other golf equipment. Golf bags are either carried by the golfer or are strapped to a golf cart, if the golfer uses one. Perhaps not surprisingly, owing to the number and diversity of the various items that are typically held in a golf bag, and owing to various modes by which golf bags are transported around a golf course, many considerations in making golf bags convenient to use have heretofore been overlooked.

Among such considerations, as recognized by the present invention, is that a golfer might want to use two classes of golf balls during a round. Specifically, a golfer might in general want to hit "good" balls but might occasionally opt to use worn balls for, e.g., drives over water hazards or other shots that raise the risk of losing a ball. Unfortunately, ball pouches in existing golf bags do not provide for separating "good" balls from "worn", requiring the golfer to sort through the balls in the pouch to find the desired ball. Or, the golfer might store the good balls in one pouch and the worn balls in another, but if the golfer forgets which pouch is which, the golfer must search through both pouches, which consumes time and becomes annoying.

Furthermore, the present invention understands that, in addition to relatively rugged golf clubs and balls, less rugged sundry items such as hats, visors, and glasses might also be stored in a golf bag. Unfortunately, existing bags do not provide, as well as might be hoped, for storing such sundry items in a golf bag such that the items are both conveniently accessible and safe from being damaged by heavier, more rugged equipment. Moreover, the present invention recognizes that the risk of damaging relatively fragile items in a golf bag is heightened if the golf bag is to be strapped to a golf cart, because as the strap is cinched tight around the bag, it can compress the bag and thereby potentially damage fragile items in the bag.

Fortunately, the present invention realizes solutions to the above-noted problems.

SUMMARY OF THE INVENTION

A golf bag includes a golf club carrier configured for receiving plural golf clubs, and at least one ball pouch cover defining at least a bottom edge hingedly attached to the carrier. The ball pouch cover can move between an open configuration either interior to the golf bag or exterior thereto. In the open configuration, whether interior or exterior, a storage pouch is exposed between the ball pouch cover and the carrier. The ball pouch cover can also be moved to a closed configuration, wherein the storage pouch is not exposed. A divider is in the ball pouch to bisect the pouch into two compartments.

Preferably, the carrier defines an interior and an exterior, and the pouch cover is movable into the interior to assume the open configuration. The pouch cover is also movable past the exterior to assume the open configuration.

In a particularly preferred embodiment, the pouch cover defines a top edge and left and right side edges, and the golf bag further includes one or more closure elements such as zippers that are engaged with the top edge and left and right edges to selectively hold the pouch cover in the closed configuration. Alternatively, the closure elements can include hook-and-eye fasteners.

If desired, the ball pouch can be combined with a sundry panel on the carrier that establishes a sundry chamber. One or more shelves are removably disposed in the sundry chamber and are configured for holding sundry items. A stiff wall at least partially encloses the sundry chamber, with the shelves being slidably disposed in the sundry chamber. To this end, shelf supports are disposed in the sundry chamber, and a sufficient number of shelf supports is provided such that at least one shelf support is unused when all shelves are disposed in the chamber to allow the user to establish the distance between shelves. Each shelf support can include one or more pegs extending outwardly from the wall, or each shelf support can include one or more rails for slidably supporting one of the shelves.

As disclosed in detail below, the golf club carrier includes a stiff club holder defining an open top configured for receiving plural golf clubs therethrough, and the golf bag further includes a stiff collar circumscribing the open top. A horizontal tube is juxtaposed with the club holder, and the tube defines opposite open ends for receiving a fastener of a golf cart therethrough to secure the golf bag to the golf cart.

In another aspect, a golf bag includes a golf club carrier configured for receiving plural golf clubs, and at least one panel on the carrier establishing a sundry chamber. Furthermore, one or more shelves are removably disposed in the sundry chamber and are configured for holding sundry items.

In still another aspect, a golf bag includes a stiff golf club holder defining an open top configured for receiving plural golf clubs therethrough. As intended by the present invention, a strap receiving channel, preferably established by a tube, is juxtaposed with the club holder, with the strap defining opposite open ends for receiving a fastener of a golf cart therethrough to secure the golf bag to the golf cart. A strap of a golf cart can be threaded through the tube to secure the golf bag to the golf cart without crushing items in the golf bag.

The details of the present invention, both as to its structure and operation, can best be understood in reference to the accompanying drawings, in which like reference numerals refer to like parts, and in which:

BRIEF DESCRIPTION OF THE DRAWINGS

FIG. 3 is a perspective view of the interior of an alternate sundry chamber; and FIG. 4 is a perspective view of the interior of another alternate sundry chamber.

FIG. 5 is a cross-section as seen along the line 5—5 in FIG. 1.

DETAILED DESCRIPTION OF THE PREFERRED EMBODIMENT

Figure 1:
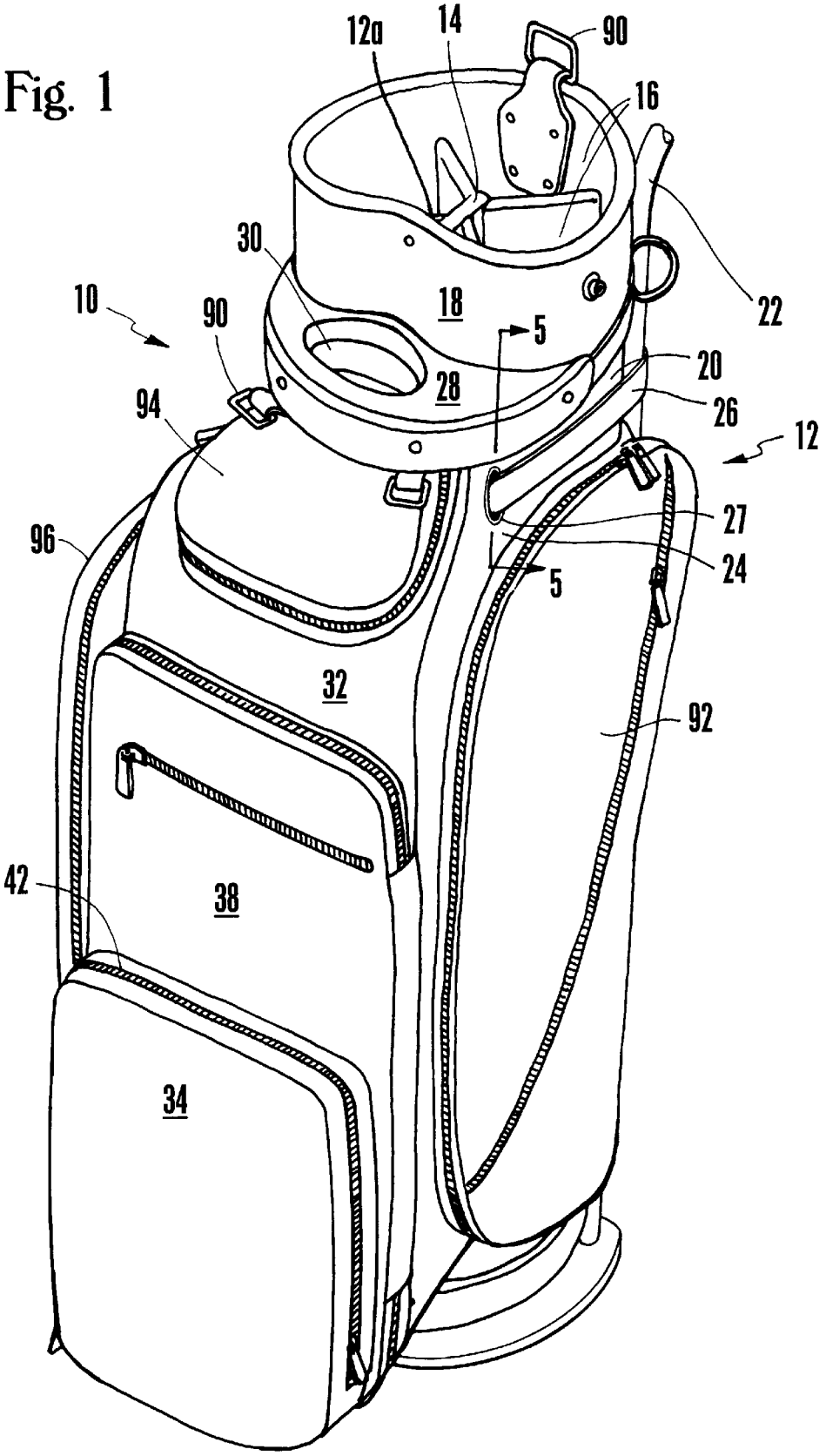
FIG. 1 is a perspective view of the golf bag with the ball pouch cover and sundry panel in the closed configurations, showing the golf bag strapped to a golf cart, with portions of the golf cart cut away for clarity.

Referring initially to FIG. 1, a golf bag is shown, generally designated 10, that includes an elongated golf club carrier 12 configured for receiving plural golf clubs. Accordingly, in one preferred embodiment an elongated cruciform-shaped divider 14 is disposed in the golf club carrier 12, to establish plural club channels 16 in the carrier 12. It is to be understood that the golf club carrier 12 includes a club holder 12A (best shown in brief reference to FIG. 2) that is substantially non-collapsing, and accordingly is made of rigid or semi-rigid plastic or cardboard.

As shown in FIG. 1, a stiff hollow collar 18 circumscribes the open top end of the club holder 12A of the carrier 12. Preferably, the collar 18 is made of rigid or semi-rigid material such as, e.g., ABS plastic. If desired, at least a lower segment of the collar 18 can be covered with fabric 20. The collar 18 can be made separately from the club holder 12A or the collar 18 can be made integrally with the club holder 12A.

In accordance with the present invention, the golf bag 10 can be strapped to a support 22 of an electric golf cart or pull cart, to retain the bag 10 on the golf cart. To this end, in cross-reference to FIGS. 1 and 5, a hollow stiff metal or plastic tube 24 or other structure for receiving a strap, e.g., molded plastic or even fabric, is disposed against the stiff collar 18 or stiff club holder 12A and is oriented horizontally relative to the long axis of the golf bag 10 when the golf bag 10 is positioned upright as shown. A strap 26 can extend through a channel 27 of the tube 24 and around the support 22, to hold the bag 10 against the support 22. Owing to the stiffness of the tube 24 and the stiff collar 18/club holder 12A, the strap 26 can be cinched tight without collapsing any part of the golf bag 10. The tube preferably is disposed between the fabric 20 and collar 18/club holder 12A. Importantly, however, the channel 27 of the present invention is structurally supported either by virtue of its own stiffness, or by virtue of being juxtaposed with a stiff support such as the holder 12A, or both, such that a strap in the channel can be cinched tight without collapsing the golf bag.

Just above the tube 24 and radially outside the collar 18, a putter carrier 28 is juxtaposed with the channels 16 of the golf club carrier 12. The putter carrier 28 defines a putter channel 30 that is shorter than the channels 16, for holding a putter therein apart from the other clubs in the channels 16. Further details of the putter carrier 28 are disclosed in co-pending U.S. patent application Ser. No. 08/787,111, filed Jan. 22, 1997 for an invention entitled "Golf Club Bag", assigned to the same assignee as is the present invention and incorporated herein by reference.

Figure 2:
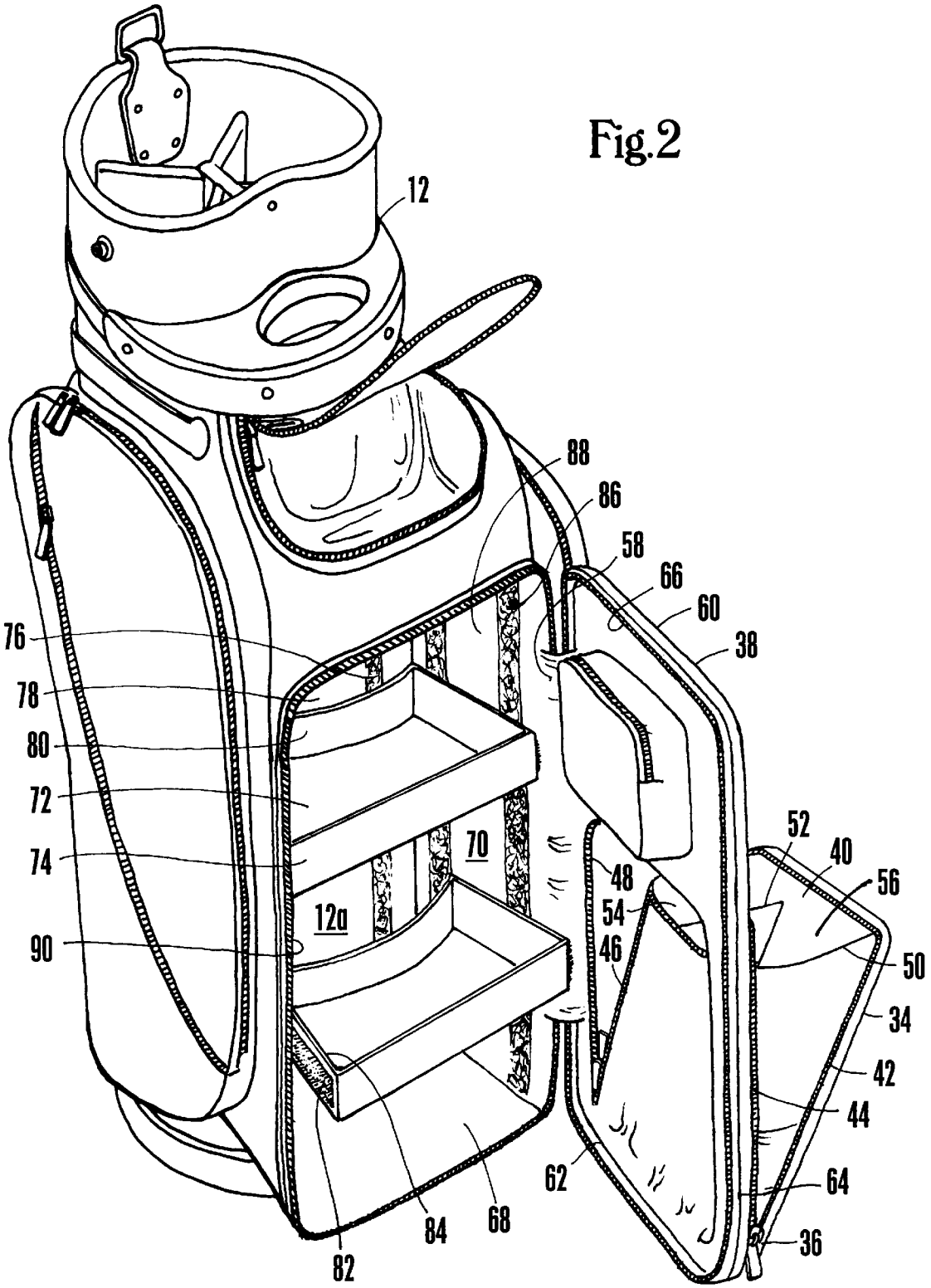
FIG. 2 is a perspective view of the golf bag with the ball pouch cover and sundry panel in the open configuration.

In cross-reference to FIGS. 1 and 2, the golf club carrier 12 can include an associated fabric pocket assembly 32, with the pocket assembly 32 defining plural pockets, pouches, and chambers. Of particular importance to the present invention is a ball pouch cover 34 of the pocket assembly 32. As shown best in FIG. 2, the ball pouch cover 34 defines a bottom edge 36 that is hingedly attached to an exterior of the carrier 12, and more particularly that is hingedly attached to a sundry panel 38 of the pocket assembly 32, for movement of the ball pouch cover 34 between an open configuration (FIG. 2), wherein a storage pouch 40 is exposed between the ball pouch cover 34 and the sundry panel 38, and a closed configuration (FIG. 1), wherein the storage chamber is not exposed. Thus, the only edge of the ball pouch cover 34 that is not selectively disengageable with the sundry panel 38 is the bottom edge 36.

One or more closure elements such as hook-and-eye fasteners or, as shown in the Figures, an outer ball pouch zipper element 42, extend around the outside top and side edges of the ball pouch cover 34. An outer panel zipper element 44 likewise extends around three outer edges of the panel 38, for selectively engaging the outer ball pouch zipper element 42 to hold the ball pouch cover 34 in the closed configuration. Also, an inner ball pouch zipper element 46 extends around the inside top and side edges of the ball pouch cover 34 as shown, and an inner panel zipper element 48 likewise extends around three inner edges of the panel 38, for selectively engaging the inner ball pouch zipper element 46 to hold the ball pouch cover 34 in the closed configuration. Further, the storage pouch 40 defmes an open top edge 50.

With this structure, it is to be appreciated that the pouch zipper 42 can be unzipped and the ball pouch cover 34 pivoted either inwardly or outwardly about the bottom edge 36, to permit access to the pouch 40 regardless of the whether the sundry panel 38 is open or closed. In other words, the pocket assembly 32 of the carrier 12 defmes an interior and an exterior, and the ball pouch cover 34 is movable into the interior to assume the open configuration, and is also movable past the exterior to assume the open configuration.

As can be appreciated in reference to FIG. 2, a fabric or nylon divider 52 is disposed in the ball pouch cover 34 in a vertical orientation to bisect the pouch 40 into first and second compartments 54, 56. The user of the golf bag 10 can conveniently keep older golf balls in the first compartment 54 and newer golf balls in the second compartment 56. In so doing, easy and quick access to all golf balls in a single, easy to remember ball pouch cover 34 is afforded, without mixing older balls (that the user might desire, for example, to hit across a water hazard) with newer balls. Or, the ball pouch can be used to hold other items such as tees, or two types of beverages, etc.

In continued reference to FIG. 2, and turning now to the sundry panel 38, as shown the sundry panel 38 is hingedly attached to rest of the pocket assembly 32 along a first side edge 58, and is selectively attachable to the remainder of the pocket assembly 32 along its top and bottom edges 60, 62 and side edge 64 by means of a closure element, such as a sundry zipper 66. In accordance with the present invention, a sundry chamber 68 is established by the sundry panel 38.

In the preferred embodiment, a stiff semi-rigid plastic wall 70 lines the sundry chamber 68. One or more shelves 72, preferably two, are removably disposed in the sundry chamber 68 and are configured for holding sundry items, such as sunglasses, hats, etc. The shelves 72 can slide in and out of the sundry chamber 68, as can be appreciated in reference FIG. 2, to facilitate access to the sundry items on the shelves 72.

In the preferred embodiment, each shelf 72 has raised walls 74 that border the edges of the shelf 72. In a particularly preferred embodiment, two co-parallel vertically-oriented strips 76 of hook-and-eye material such as Velcro® extend down a rear wall 78 of the sundry chamber 68, and complementarily configured hook-and-eye material is adhered to a respective rear wall 80 of each shelf 72 to engage the strips 76.

Moreover, in the embodiment shown in FIG. 2, hook-and-eye material 82 is adhered to the sides 84 of each shelf 72 for engaging side strips 86 of complementarily configured hook-and-eye material on the sides 88, 91 of the sundry chamber 68. The hook-and-eye material establishes a shelf support that cooperates to hold the shelves 72 in the sundry chamber 68, while permitting a person to grasp a shelf 72 and pull it outwardly to disengage the hook-and-eye fasteners set forth above and slide the shelf 72 out of the chamber 68.

Alternatively, FIG. 3 shows a golf bag, generally designated 100, which includes a sundry panel 102 that selectively covers a sundry chamber 104. The golf bag 100 shown in FIG. 3 is in all essential respects identical to the golf bag 10 shown in FIGS. 1 and 2, with the exception that sides 106 of shelves 108 do not have hook-and-eye material adhered thereto, nor do sides 110 of the chamber 104 have hook-and-eye material adhered thereto. In other words, the shelf supports of the bag 100 shown in FIG. 3 are not exclusively hook-and-eye material. Rather, as shown the shelves 108 slide on and are supported by pairs of opposed rails 112*a*, 112*b*, 112*c* that are attached to the sides 110 of the chamber 104.

Moreover, when two shelves 108 are provided, preferably three pairs of rails 112*a–c* are provided, such that at least one shelf support is unused when all shelves are disposed in the chamber. It is to be understood that if desired, instead of sliding on the rails 112*a–c*, the sides 106 of the shelves 108 can be formed with keyways that closely receive the rails 112*a–c*. As was the case with the above-described golf bag 10, however, two or more vertically-oriented strips 114 of hook-and-eye material extend down a rear wall 116 of the sundry chamber 104, and complementarily configured hook-and-eye material is adhered to a respective rear wall 118 of each shelf 108 to engage the strips 114.

FIG. 4 shows a golf bag, generally designated 200, that is in all essential respects identical to the golf bag 100 shown in FIG. 3, with the exception that the shelf supports of a sundry chamber 202 are not rails, but sets of opposed pegs 204 that extend inwardly from sides 206 of the chamber 202. Specifically, three sets of four pegs 204 each, two pegs 204 per side 206 per set, are provided, to slidably support two shelves 208 (only a single shelf 208 shown for clarity).

Referring back to FIG. 1, the golf bag 10 can include additional features including one or more buckles 90 that are conventionally attached to the collar 18 and golf carrier 12 for well-known uses. Also, auxiliary zippered pocket covers 92, 94, 96 defining respective pockets therein can be included on the pocket assembly 32 as shown.

While the particular GOLF BAG WITH DIVIDED BALL POUCH, SLIDING SHELVES, AND CART STRAP SECURING SYSTEM as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more".

What is claimed is:

1. A golf bag, comprising:

a golf club carrier configured for receiving plural golf clubs;

at least one ball pouch cover defining at least a bottom edge hingedly attached to the carrier for movement of the ball pouch cover between an open configuration, wherein a storage pouch is exposed between the ball pouch cover and the carrier, and a closed configuration, wherein the storage pouch is not exposed, wherein the carrier defines an interior and an exterior, the pouch cover being movable into the interior to assume the open configuration, the pouch cover also being movable past the exterior to assume the open configuration such that the storage pouch can be accessed from inside or outside the carrier; and a divider in the ball pouch bisecting the pouch, wherein the golf club carrier includes a club holder defining an open top configured for receiving plural golf clubs therethrough, and the golf bag further comprises:

a horizontal tube juxtaposed with the club holder and defining opposite open ends for receiving a fastener of a golf cart therethrough to secure the golf bag to the golf cart.

2. The golf bag of claim 1, wherein the pouch cover defines a top edge and left and right side edges, the golf bag further comprising at least one closure element engaged with the top edge and left and right edges.

3. The golf bag of claim 2, wherein the closure element includes zippers.

4. The golf bag of claim 1, further comprising:

at least one panel on the carrier establishing a sundry chamber; and at least one shelf removably disposed in the sundry chamber and configured for holding sundry items.

5. The golf bag of claim 4, further comprising a stiff wall at least partially enclosing the sundry chamber.

6. The golf bag of claim 5, wherein the shelves are slidably disposed in the sundry chamber.

7. The golf bag of claim 6, further comprising shelf supports in the sundry chamber, a sufficient number of shelf supports being provided such that at least one shelf support is unused when all shelves are disposed in the chamber.

8. The golf bag of claim 7, wherein each shelf support includes at least one peg extending outwardly from the wall.

9. The golf bag of claim 7, wherein each shelf support includes at least one rail and each shelf is slidably engageable with respective rails.

10. The golf bag of claim 4, wherein the golf bag further comprises:

a stiff collar circumscribing the open top, the tube being closely juxtaposed with the collar.

11. The golf bag of claim 10, further comprising a fabric covering at least a portion of the club holder, the tube being disposed between the fabric and club holder.

12. The golf bag of claim 11, wherein the tube is stiff.

13. The golf bag of claim 1, further comprising a fabric covering at least a portion of the club holder, the tube being disposed between the fabric and club holder.

14. The golf bag of claim 13, wherein the tube is stiff.

15. A golf bag, comprising:

a golf club carrier configured for receiving plural golf clubs;

at least one panel on the carrier establishing a sundry chamber;

shelf supports in the sundry chamber; and at least one shelf horizontally slidably engaged with the shelf supports in the sundry chamber and configured for holding sundry items.

16. The golf bag of claim 15, further comprising a stiff wall at least partially enclosing the sundry chamber.

17. The golf bag of claim 15, wherein a sufficient number of shelf supports are provided such that at least one shelf support is unused when all shelves are disposed in the chamber.

18. The golf bag of claim 15, wherein each shelf support includes at least one peg extending outwardly from the wall.

19. The golf bag of claim 18, wherein each shelf support includes at least one rail and each shelf is slidably engageable with respective rails.

20. The golf bag of claim 15, wherein the golf club carrier includes a club holder defining an open top configured for receiving plural golf clubs therethrough, and the golf bag further comprises:

a stiff collar circumscribing the open top; and a horizontal tube juxtaposed with the club holder and defining opposite open ends for receiving a fastener of a golf cart therethrough to secure the golf bag to the golf cart.

21. The golf bag of claim 20, further comprising a fabric covering at least a portion of the club holder, the tube being disposed between the fabric and club holder.

22. The golf bag of claim 21, wherein the tube is stiff.

23. A golf bag, comprising:

a golf club holder defining an open top configured for receiving plural golf clubs therethrough; and a strap receiving channel juxtaposed with the club holder and defining opposite open ends for receiving a fastener of a golf cart therethrough to secure the golf bag to the golf cart, the channel being established by a horizontal tube.

24. The golf bag of claim 23, further comprising a fabric covering at least a portion of the club holder, the tube being disposed between the fabric and club holder.

25. The golf bag of claim 23, wherein the tube is stiff.

26. The golf bag of claim 23, further comprising:

a stiff collar circumscribing the open top, the tube being juxtaposed with the club holder and defining opposite open ends for receiving a fastener of a golf cart therethrough to secure the golf bag to the golf cart.

27. The golf bag of claim 23, further comprising:

a golf club carrier including the club holder;

at least one ball pouch cover defining at least a bottom edge hingedly attached to the carrier for movement of the ball pouch cover between an open configuration, wherein a storage pouch is exposed between the ball pouch cover and the carrier, and a closed configuration, wherein the storage pouch is not exposed; and a divider in the ball pouch bisecting the pouch.

28. The golf bag of claim 27, wherein the carrier defines an interior and an exterior, the pouch cover being movable into the interior to assume the open configuration, the pouch cover also being movable past the exterior to assume the open configuration.

29. The golf bag of claim 28, wherein the pouch cover defines a top edge and left and right side edges, the golf bag further comprising one or more closure elements engaged with the top edge and left and right edges.

30. The golf bag of claim 29, wherein the closure elements include zippers.

31. The golf bag of claim 29, wherein the closure elements include hook-and-eye fasteners.

32. The golf bag of claim 27, further comprising:

at least one panel on the carrier establishing a sundry chamber; and one or more shelves removably disposed in the sundry chamber and configured for holding sundry items.

33. The golf bag of claim 32, further comprising a stiff wall at least partially enclosing the sundry chamber.

34. The golf bag of claim 33, wherein the shelves are slidably disposed in the sundry chamber.

35. The golf bag of claim 34, further comprising shelf supports in the sundry chamber, a sufficient number of shelf supports being provided such that at least one shelf support is unused when all shelves are disposed in the chamber.

36. The golf bag of claim 35, wherein each shelf support includes one or more pegs extending outwardly from the wall.

37. The golf bag of claim 35, wherein each shelf support includes one or more rails and each shelf is slidably engageable with respective rails.

* * * * *

UNITED STATES PATENT AND TRADEMARK OFFICE

CERTIFICATE OF CORRECTION

PATENT NO. : 5,988,379
DATED : November 23, 1999
INVENTOR(S) : Jeffrey Blaine Yearous It is certified that error appears in the above-identified patent and that said Letters Patent is hereby corrected as shown below:

Drawings,
Please change reference numeral "90" in Figure 2 to -- 91 -- as changed by Applicant in the Office Action response dated December 8, 1998 but not carried over to the formal drawings as submitted.

Column 4,
Lines 9 and 16, please change the misspelled words "dfmes" to -- defines -- as originally filed by Applicant.

Claims,
Please change the dependency of Claim 19 from Claim 18 to Claim 15, as amended by Applicant in the response dated June 16, 1999 (amending original Claim 23, issued as Claim 19).

Signed and Sealed this

Sixth Day of November, 2001

*Attest:*

Nicholas P. Godici

NICHOLAS P. GODICI
*Acting Director of the United States Patent and Trademark Office*

*Attesting Officer*